US006697033B1

(12) United States Patent
Leung et al.

(10) Patent No.: US 6,697,033 B1
(45) Date of Patent: Feb. 24, 2004

(54) METHOD AND SYSTEM FOR CHANGING A DISPLAY DEVICE ON A COMPUTER SYSTEM DURING OPERATION THEREOF

(75) Inventors: Kwok-Chiu Leung, Scarborough (CA); Xiaokang Zhang, Markham (CA); Foo-Yat Fong, Scarborough (CA)

(73) Assignee: ATI International Srl, Barbados (KN)

( * ) Notice: Subject to any disclaimer, the term of this patent is extended or adjusted under 35 U.S.C. 154(b) by 31 days.

(21) Appl. No.: 09/724,456

(22) Filed: Nov. 28, 2000

(51) Int. Cl.[7] ..... G09G 5/00; G09G 5/02
(52) U.S. Cl. ..... 345/5; 345/698
(58) Field of Search ..... 345/1, 3, 132, 345/213, 428, 698, 204, 5, 785; 710/63, 69, 70; 364/200; 713/300

(56) References Cited

U.S. PATENT DOCUMENTS

| | | | | |
|---|---|---|---|---|
| 4,419,724 A | * | 12/1983 | Branigin et al. | 710/108 |
| 5,943,029 A | * | 8/1999 | Ross | 345/11 |
| 6,049,316 A | * | 4/2000 | Nolan et al. | 345/698 |
| 6,178,513 B1 | * | 1/2001 | Lee | 713/300 |
| 6,223,283 B1 | * | 4/2001 | Chaiken et al. | 713/1 |
| 6,295,048 B1 | * | 9/2001 | Ward et al. | 345/785 |
| 6,314,479 B1 | * | 11/2001 | Frederick et al. | 709/208 |
| 6,373,476 B1 | * | 4/2002 | Dalgleish et al. | 345/204 |

FOREIGN PATENT DOCUMENTS

JP 02000194346 A * 7/2000

OTHER PUBLICATIONS

VESA Video Electronics Standard Association Plug and Display Standard (pp. 13, 21–24) 1997.*

* cited by examiner

*Primary Examiner*—Vijay Shankar
*Assistant Examiner*—Prabodh M. Dharia
(74) *Attorney, Agent, or Firm*—Vedder, Price, Kaufman & Kammholz, P.C.

(57) ABSTRACT

A method and system connects a display device or other device to a computer system during operation of the system. Initially a run time EDID (Extended Display Identification Data) flag is set to a first value indicating no run time EDID is required. By monitoring for an interrupt a checking is carried out for a change to a new display device in the computer system. If no change to a new display device is detected, the run time EDID flag is checked. If the run time EDID flag indicates that no run time EDID is required, an EDID is read from a video BIOS on a graphics adapter in the computer system. If the run time EDID flag indicates that a run time EDID is required, an EDID is read from a video memory on a graphics adapter in the computer system. If a change to a new display device is detected, the run time EDID flag is set to a second value and EDID is then downloaded from the new display device.

13 Claims, 2 Drawing Sheets

METHOD AND SYSTEM FOR CHANGING A DISPLAY DEVICE ON A COMPUTER SYSTEM DURING OPERATION THEREOF

FIELD OF THE INVENTION

The present invention relates generally to computer systems having a display device, and in particular to removing a current display device from the computer system and connecting a new display device to the computer system during operation of the computer system.

BACKGROUND OF THE INVENTION

Typical prior art computer system has a display device or CPU (central processing unit) operatively connected to a system memory and to a graphics card or video board. A display device is then connected to the graphics card or video board in order to display images supplied by the CPU. A configuration of the computer system refers to the assortment of components that make up the system and their interconnection. Configuration can refer to either hardware or software or the combination of both. For example, a typical configuration for a personal computer consists of a main system memory, a floppy drive, a hard drive, a modem, a CD ROM drive, a monitor of display device, and an operating system. Many software applications require that the computer system have a certain minimum configuration, for example, software that requires graphics display monitor and a video adapter, a particular microprocessor, and a minimum amount of main system memory.

It is well known in the prior art that when a new device or program is installed in the computer system, the system must be reconfigured. This means that certain switches and jumpers must be set for hardware, or new values must be defined for parameters for software. The video adapter is a board that plugs into the computer to give it display capabilities. Obviously, the display capabilities are a function of the display device, which is connected to the video adapter. Adapters offer different types of video modes, the two basic categories of video modes being text and graphics. Also, display devices typically offer a choice of resolutions from the image displayed. Video adapters contain their own memory so that the computer system's main system memory or RAM is not used for storing displays. If the video adapters perform graphics calculations then they have graphics co-processors and are typically referred to as graphics accelerators.

In order for the computer system to recognize the type of display device, which is connected thereto, each display device has what is termed extended display identification data (EDID). The EDID is a VESA standard data format that contains basic information about the display device and its capabilities, including vendor information, maximum image size, color characteristics, factory pre-set timings, frequency range limits, and character strings for the display device name and serial number. This information is stored in the display device and is used to communicate with the system through, typically, a display data channel between the display device and the graphics adapter. The system uses this information for configuration of the system.

In prior art systems there was limited space for storing the EDID in the computer system. During run time of the computer system the BIOS space is write protected and no EDID data can be stored in the BIOS space during run time. Additionally, it takes relatively a long time to read the EDID from the display device. Thus, it cannot be read every time a mode is set since it introduces extremely long periods of time when mode query is done by third party software. In addition, when hot plugging display devices (disconnecting one display device and connecting a different display device during operation of the computer system), the EDID data sizes are not known until actually reading and analyzing the EDID. In the prior art, dynamic allocation of required storage space is impossible.

Therefore, it is a drawback of the prior art that a computer system cannot be readily reconfigured for a different display device during operation of the computer system.

BRIEF DESCRIPTION OF THE DRAWINGS

The invention may best be understood by reference to the following description taken in conjunction with the accompanying drawings, in the several figures of which like reference numerals identify like elements.

DETAILED DESCRIPTION OF A PREFERRED EMBODIMENT OF THE INVENTION

In general terms, the method and system connects a display device or other device to a computer system during operation of the system. Initially a run time EDID (Extended Display Identification Data) flag is set to a first value indicating no run time EDID required. By monitoring for an interrupt a checking is carried out for a change to a new display device in the computer system. If no change to a new display device is detected, the run time EDID flag is checked and if the run time EDID flag indicates that no run time EDID is required, an EDID is read from a video BIOS on a graphics adapter in the computer system. If the run time EDID flag indicates that a run time EDID is required, an EDID in read from a video memory on a graphics adapter in the computer system. If a change to a new display device is detected, the run time EDID flag is set to a second value. An EDID is then downloaded from the new display device to a video memory on the graphics adapter in the computer system. The EDID is then read from the video memory of the graphics adapter in the computer system. The computer system is then configured for the new display device using the EDID.

The present invention allows a computer system to continue operation while a first display device is disconnected from the system and a second display device is connected into the system. The second display device is different from the first display device. Initially, a flag is set to a first value and indicates that no run time EDID is required. When an interrupt occurs, the computer system is determined if a new display device has been connected to the computer system. If there has been no change to a new display device, then the flag is checked to determine if a run time EDID is required. If the run time EDID is not required, the EDID is read from the video BIOS and the computer system is configured according to that EDID. If a run time EDID is required, then the EDID is read from the video memory for reconfiguration of the system. If, however, it is detected that a new display device has been connected to the computer system, then the EDID run time flag is set to the second value. The EDID is then downloaded from the display device to the video memory. Thereafter the EDID is read from the video memory for reconfiguration of the system for the new display device.

Figure 1:
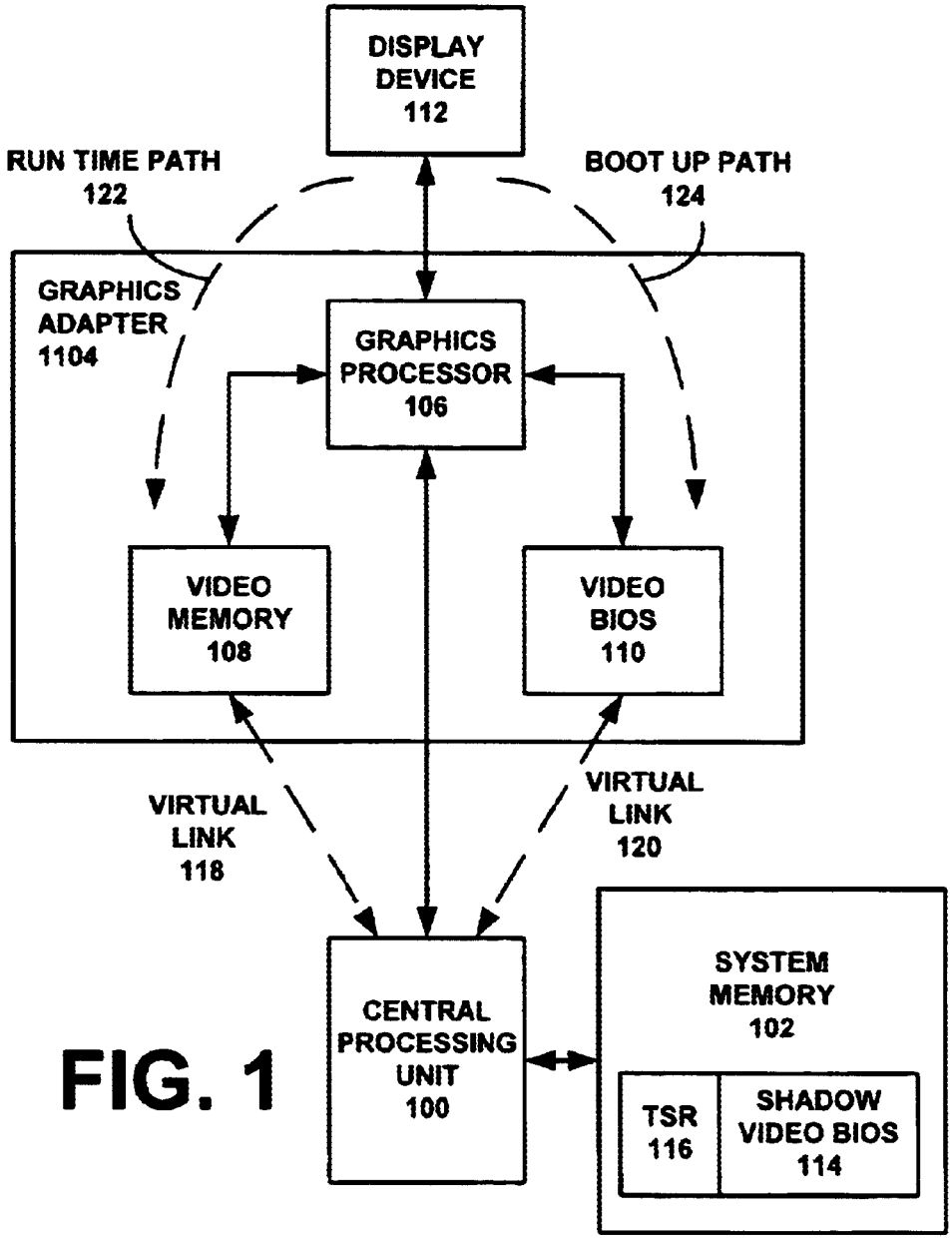
FIG. 1 is a block diagram of a computer system that utilizes the present invention.

FIG. 1 depicts a portion of a computer system which implements the method of the present invention. A processing device or CPU 100 is operatively connected to a system memory 102 and to a graphics adapter 104. The graphics adapter 104 has a graphics processor 106, which is an application-specific integrated circuit. The graphics processor 106 is connected to a video memory 108 on the graphics adapter 104 and to video BIOS 110. The graphics processor 106 is also operatively connected to the CPU 100 and to a display device 12. The CPU 100 is connected to the video memory 108 by a virtual link 118, and is connected to the video BIOS 110 by virtual link 120.

When the computer system is initially turned on and booted up, the graphics processor 106 and the graphics adapter 104 reads the EDID from the display device 112 and transfers it to the video BIOS 110 (path 124). On some computer systems the video BIOS 110 is shadowed, that is a copy of the video BIOS 110 is stored in the system memory 102 in the memory portion 114. The shadowing of the video BIOS 110 occurs at boot up. During boot up and only during boot up, the EDID is read from the video BIOS 110. The CPU 100 then proceeds to configure the system for the display device 112, which is currently connected to the graphics adapter 104. A typical implementation of the graphics adapter 104 is the Rage 128 Pro TM graphics adapter manufactured by ATI Technologies, Incorporated. The method of the present invention is implemented in a software routine, which is stored in the system memory 102 in a memory area 116. The software routine is a terminate and stay resident (TSR). The TSR's reside in memory at all times once they are loaded and can be instantly accessed from other programs. A TSR cannot be swapped out of memory by the computer system. The software routine of the present invention remains in the system memory area 116 of the system memory 102 and monitors the computer system for an interrupt, which occurs when display devices are hot swapped.

Figure 2:
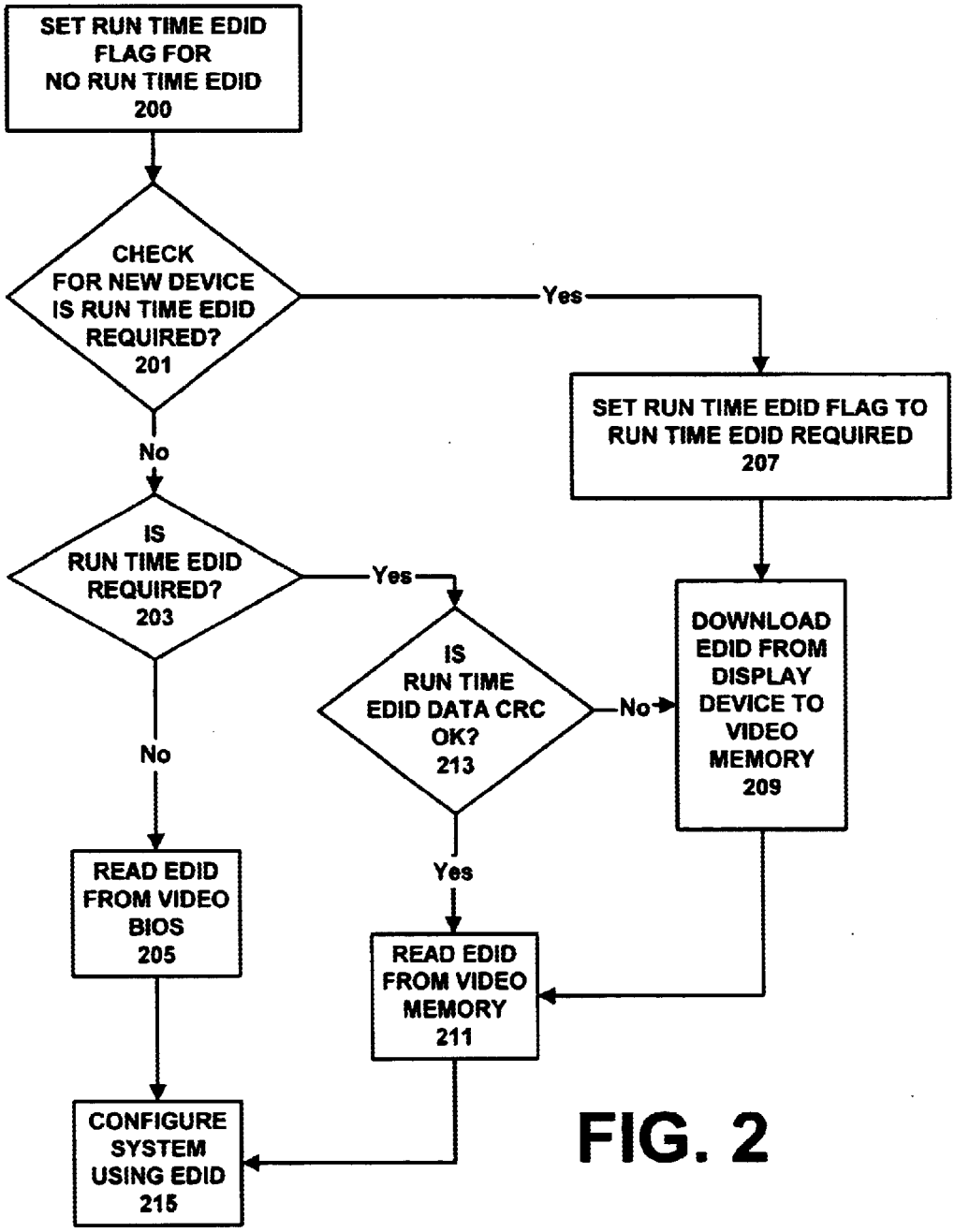
FIG. 2 is a flow chart depicting the method of the present invention.

FIG. 2 is a flow chart depicting the method of the present invention. Initially in step 200, a run time flag is set to a first value which indicates that there has been no change of a display device. In step 201, it is determined if a new display device has been connected to the computer system. Such a detection, for example, can occur by monitoring the computer system for an interrupt. If there is no detected change of a display device then a determination is made as to whether a run time EDID is required in step 203. If no run time EDID is required, then the current EDID is read from the video BIOS 110 on the graphics adapter 104. Only at boot up of the computer system will no display device change be detected as well as no requirement for a run time EDID resulting in the step 205 of reading the EDID from the video BIOS 110.

If in step 201 an interrupt in the computer system has occurred and then detected, it is an indication that a new display device has been connected to the computer system. Then in step 207 the run time EDID flag is set to a second value indicating the change in the display device. Thereafter, the new EDID is downloaded from the new display device to the video memory 108 in the graphics adapter 104. The CPU 100 then reads the EDID from the video buffer 108 in step 211. It is to be understood that in some computer systems the CPU 100 would read the EDID from the shadowed video BIOS in the area 114 of the system memory 102.

If there was no change of the display device detected in step 201 but the run time EDID flag had been set to the second value indicating that the run time EDID was required in step 203, then in step 213 it is determined if the run time data is checked by doing a CRC (cyclical redundancy checking) which is a standard error checking technique used to ensure the accuracy of transmitting digital data. If it is determined in step 213 that the CRC of the run time EDID data is downloaded from the display device to the video memory in step 209, the EDID is then read from the video memory by the CPU 100 in step 211. If the run time EDID data CRC is okay in step 213, then the EDID is immediately read from the video memory in step 211. The computer system is finally configured or reconfigured, as the case may be, in step 215.

It is to be understood that although the example above is provided for a graphics adapter 104, the principles of the present invention can be applied to other application specific integrated circuits (ASIC) that are connected to the computer system and that have devices connected thereto which are interchanged. In general, the method of the present invention detects the device change when the CPU has an interruption. The software routine of the present invention is stored in system memory and is a TSR that communicates with the ASIC. Thus, the software routine for a device change in the computer system detects the CPU interrupt and the software is thus invoked and communicates with the graphics adapter. Thereafter, it analyzes the EDID and sets the parameters for the new device.

The present invention stores the EDID in the top boundary area of the video memory with the size being allocated as a function of the EDID size. Memory is reserved so that the EDID need not be read every time the mode is set as is done in the prior art. EDID data integrity in memory is verified before a decision is made to reread the EDID. Also, dynamic allocation of temporary storage is possible with the present invention when hot plugging display devices.

Thus, the present invention overcomes the drawbacks of the prior art, which had limited space for storing the EDID, and overcomes the problem of the relatively long time period for reading EDIDs when queried by third parties, as well as handling of hot plugging of display devices.

The present invention is not limited to the particular details of the apparatus and method depicted, and other modifications and applications are contemplated. Certain other changes may be made in the above-described apparatus without departing from the true spirit and scope of the invention herein involved. For example, the software routine of the present invention can be utilized in a computer system in which a variety of devices are changed, as well as, display devices. The method of the present invention can also be utilized in a variety of different graphic adapters, video cards and graphic accelerators. It is intended, therefore, that the subject matter of the above depiction shall be interpreted as illustrative and not in a limiting sense.

What is claimed is:

1. A method for connecting a display device to a computer system during operation of the system, comprising the steps of:

a) setting initially a run time EDID (Extended Display Identification Data) flag to a first value indicating no run time EDID required;

b) checking for a change to a new display device in the computer system;

c) if no change to a new display device is detected, checking the run time EDID flag and if the run time EDID flag indicates that no run time EDID is required, reading an EDID from a video BIOS on a graphics adapter in the computer system, and going to step e), and if the run time EDID flag indicates that a run time EDID is required, reading an EDID from a video memory on a graphics adapter in the computer system, and going to step e);

d) if a change to a new display device is detected, setting the run time EDID flag to a second value, downloading an EDID from the new display device to a video memory on the graphics adapter in the computer system, reading the EDID from the video memory of the graphics adapter in the computer system and going to step e); and e) configuring the computer system for the new display device using the EDID.

2. The method according to claim 1 wherein step b) of checking for a change to a new display device comprises detecting an interrupt in a CPU of the computer system during operation of the computer System.

3. The method according to claim 1 Wherein the method is executed by a software routine stored in a system memory of the computer system.

4. The method acoording to claim 3, wherein the external software routine is a terminate and stay resident in the computer system.

5. A method for connecting a new display device to a computer system during operation of the system, comprising the steps of:

a) providing a software routine that responds to an interrupt of a CPU of the computer system based on a run time EDID (Extended Display Identification Data) flag indicating a run time EDID is required;

b) determining by the software routine, in response to the interrupt in the computer system, that a new display device has been connected to the computer system;

c) if no change to a new display device is detected checking the run time EDID flag and if the run time EDID flag indicates that no run time EDID is required, reading an EDID from a video BIOS on a graphics adapter in the computer system, and going to step e), and if the run time EDID flag indicates that a run time EDID is required, reading the EDID from a video memory on a graphics adapter in the computer system, and going to step e);

d) if a change to a new display device is detected, setting the run time EDID flag to a second value, downloading an EDID from the new display device to a video memory on the graphics adapter in the computer system, reading the EDID from the video memory of the graphics adapter in the computer system and going to step e); and e) reading the new run time EDID from the video memory of the graphics adapter of the computer system and configuring the computer system for the new display device using the new run time EDID.

6. The method according to claim 5 wherein step b) of checking for a change to a new display device comprises detecting an interrupt in a CPU of the computer system during operation of the computer system.

7. The method according to claim 5 wherein the method is executed by a software routine stored in a system memory of the computer system.

8. The method according to claim 5, wherein the software routine is a terminate and stay resident in the computer system.

9. A system for connecting a display device to a computer system during operation of the system, comprising:

a central processing unit;

a graphics adapter operably connected to the central processing unit, the graphics adapter having a graphics processor operably connected to a video memory and a video BIOS;

a display device operably connected to the graphics processor in the display device;

a system memory operably connected to the central processing unit, wherein the memory stores operating instructions that cause the central processing module to: (a) set initially a run time EDID (Extended Display Identification Data) flag to a first value indicating no run time EDID required; (b) checking for a change to a new display device in the computer system; (c) if no change to a new display device is detected, checking the run time EDID flag and if the run time EDID flag indicates that no run time EDID is required, reading an EDID from a video BIOS on a graphics adapter in the computer system, and going to step e, and if the run time EDID flag indicates that a run time EDID is required, reading an EDID from a video memory on a graphics adapter in the computer system, and going to step e;

(d) if a change to a new display device is detected, setting the run time EDID flag to a second value, downloading an EDID from the new display device to a video memory on the graphics adapter in the computer system, reading the EDID from the video memory of the graphics adapter in the computer system and going to step e; and (e) configuring the computer system for the new display device using the EDID.

10. The system according to claim 9 wherein step b) of checking for a change to a now display device comprises detecting an interrupt in a CPU of the computer system during operation of the computer system.

11. The system according to claim 9 wherein the method is executed by a software routine stored in a system memory of the computer system.

12. The system according to claim 11, wherein the software routine is a terminate and stay resident in the computer system.

13. A method for connecting a new display device to a computer system during operation of the system, comprising the steps of:

a) providing a software routine that responds to an interrupt of a CPU of the computer system based on a run time EDID (Extended Display Identification Data) flag indicating a run time EDID is required;

b) determining by the software routine, in response to the interrupt in the computer system, that a new device has been connected to the computer system;

c) if no change to a new display device is detected, checking the run time EDID flag and if the run time EDID flag indicates that no run time EDID is require, reading an EDID from a video BIOS on a graphics adapter in the computer system, and going to step e), and if the run time EDID flag indicates that a run time EDID is required, reading an EDID from a predetermined memory on a graphics adapter in the computer system, and going to step e);

(d) if a change to a new display device is detected, setting the run time EDID flag to a second value, downloading an EDID from the new device to a predetermined memory on the computer system, reading the EDID from memory in the computer system and going to step e); and e) reading the new run time EDID from the predetermined memory in the computer system and configuring the computer system for the new display device using the new run time EDID.

* * * * *